US005123815A

United States Patent [19]

Larkin et al.

[11] Patent Number: 5,123,815

[45] Date of Patent: Jun. 23, 1992

[54] FLUID PUMPING APPARATUS WITH LOAD LIMITING CONTROL

[75] Inventors: Bruce D. Larkin, Plainwell; Paul K. Houtman, Gobles, both of Mich.

[73] Assignee: Parker Hannifin Corporation, Cleveland, Ohio

[21] Appl. No.: 661,035

[22] Filed: Feb. 25, 1991

[51] Int. Cl.[5] ..... F04B 1/26

[52] U.S. Cl. ..... 417/222 R; 417/218; 91/505

[58] Field of Search ..... 417/218, 219, 222 R; 91/505, 506

[56] References Cited

U.S. PATENT DOCUMENTS

| | | | |
|---|---|---|---|
| 3,612,724 | 10/1971 | Smith | 417/222 |
| 3,700,356 | 10/1972 | Kubik | 417/222 |
| 3,806,280 | 4/1974 | Bobier | 417/222 |
| 4,013,380 | 3/1977 | Pensa | 417/218 |
| 4,072,442 | 2/1978 | Horiuchi | 417/218 |
| 4,097,196 | 6/1978 | Mabiger | 417/222 |
| 4,355,510 | 10/1982 | Ruseff | 417/222 |
| 4,381,647 | 5/1983 | Ruseff | 417/222 |
| 4,617,797 | 10/1986 | Williams | 417/222 |
| 4,715,788 | 12/1987 | Kouns | 417/222 |

*Primary Examiner*—Richard A. Bertsch

*Assistant Examiner*—Peter Korytnyk

*Attorney, Agent, or Firm*—Ralph E. Jocke

[57] ABSTRACT

A fluid power pumping apparatus having a control system for limiting the power loading thereon to the power available from a motor (126) driving the apparatus, includes a variable displacement rotating piston pump (122). A compensating valve assembly (128) of a type known in the prior art is mounting on the pump. The compensating valve controls flow volume through the pump in response to pressure at an outlet (130) of the compensating valve. The outlet is connected to a variable pressure relief valve (134). The relief pressure of the relief valve varies according to the position of a cam (140) which is connected to the swash plate of the pump. The relief pressure of the variable pressure relief valve and the control pressure on the compensating valve are both at their maximums when the pump is at a minimum flow condition and vice versa. The variable pressure relief valve provides mechanical feedback in the control of the pump which reduces flow in response to increased pressure loading and prevents such loading from exceeding the power capability of the motor. The control system also provides for the pumping apparatus to increase flow at reduced pressures.

6 Claims, 6 Drawing Sheets

FLUID PUMPING APPARATUS WITH LOAD LIMITING CONTROL

TECHNICAL FIELD

This invention relates to pumping apparatus used in fluid power systems. Specifically, this invention relates to a power limiting control system for a variable displacement rotating piston pump.

BACKGROUND ART

Variable displacement rotating pumps are well known in the prior art. Such pumps are often used in hydraulic systems to provide fluid power to components such as hydraulic cylinders and rotary actuators. An exploded view of a typical variable displacement rotating piston pump is shown in FIG. 1.

The pump generally indicated 10 includes a case 12 which has a first section 14 and a second section 16. A plurality of movable pistons 18 are mounted inside the case in a carrier 20. A spring inside carrier 20 biases multiple pins 15 against a ball guide 17. The ball guide pushes against a slipper plate 19. The slipper plate 19 biases the pistons away from the carrier. The carrier and pistons are rotatable inside the case when driven by a drive shaft 22.

A swash plate 24 is mounted inside the pump case. A wear plate 26 is positioned on the swash plate when the pump is assembled. As later explained, when the pump is operated, the pistons 18 ride on the wear plate 26. The swash plate is mounted to the case by a pair of mounting pins 28 which extend into mounting holes 30 in the first section of the case. Bearings 34 support the pins in the mounting holes, and retaining rings 36 keep the bearings and pins from moving laterally inside the case. The mounting of the swash plate 24 enables it to swivel about an axis perpendicular to the axis of rotation of shaft 22 and pistons 18.

A balancing spring 38 is mounted in the pump case. A spring guide 40, positioned on spring 38, contacts swash plate 24 to bias it in a first direction. A servo piston 42 is mounted on the second section 16 of the case. Servo piston 42 contacts swash plate 24 on a side opposite spring guide 40.

A fluid directing plate 44 is mounted adjacent to piston carrier 20 and directs fluid into inlet and outlet passage 46 and 48 respectively, in the second section 16 of the pump case.

The operation of the variable displacement rotating piston pump is now explained with reference to FIG. 2. Fluid is delivered to the pump through an inlet 50 in case 12. The inlet 50 is connected to inlet passage 46. Fluid in the inlet passage flows into the pistons 18 when they are located in the lower portion of the pump as shown in FIG. 2. When servo piston 42 is in the retracted position as shown in FIG. 2, swash plate 24 is tilted at an angle by the force of spring 38

The pistons 18 include ball shaped slippers 52 which swivel. The ball shaped slippers also include a small fluid passage 54. A small amount of fluid flows to the bottom of the ball shaped slippers through passages 54 which enables the piston assemblies to slide on wear plate 26 with minimum friction.

When shaft 22 rotates, it rotates carrier 20 and the pistons 18. As shown in FIG. 2, because swash plate 24 is tilted, the fluid is pushed out as the pistons approach the upper portion of the pump case and fluid flows out of outlet passage 48. As a result, fluid is delivered from the pump at an outlet 56. Fluid is pulled into the pistons when they are pulled away from the fluid directing plate 44 as they pass through the opposite area of their rotational path. As can be seen in FIG. 2, the greater the angle of swash plate 24, the larger the volume of fluid pumped at a given rotational speed of the shaft.

Fluid power systems typically operate at variable pressures. This is because the devices that perform the work, a hydrualic cylinder for example, often encounter variable resistance to movement. A log splitter which operates using a hydraulic cylinder is an example of this phenomenon. The wedge which contacts and splits the log is attached to the cylinder. Until the wedge contacts the log, the cylinder moves the wedge with little resistance. As a result, pressure of the working fluid in the cylinder is low. When the wedge contacts the log, the resistance to further movement (and the pressure inside the cylinder) builds rapidly. Once the log fractures, the resistance force drops and the corresponding pressure in the cylinder drops as the wedge continues to move against lesser resistance.

If a piston pump with a fixed displacement were used to power the hydraulic cylinder of a log splitter or other device that encounters variable force, the amount of power required to drive the pump during the high pressure periods would be very high. This, a very large motor would be required. Further, if the power required to drive the log spitter or other device became higher than the motor could deliver, the motor would stall and the pump would stop.

Variable displacement rotating piston pumps can be used to minimize these problems. This is accomplished by varying the angle of the swash plate. When the pressure in the system rises, the flow through the pump is reduced. This maintains the amount of power the motor driving the pump must supply within a manageable range.

A prior art system which reduces the flow through the pump at high pressure is shown in FIG. 2. This system involves use of a first compensator valve assembly 58. Valve assembly 58 has a body which houses a first internal chamber 62 and a second internal chamber 64. A compensator spool 66 is movably mounted in the first internal chamber 62. A pre-load spring 68 is mounted in the second internal chamber 64. The pre-load spring 68 biases compensator spool 66 to the left as shown in FIG. 2. The biasing force is set by turning an adjusting nut 70 which is attached to an adjusting rod 72 threaded in body 60.

First chamber 62 is in fluid communication with outlet passage 48 through a fluid passage 74. First chamber 62 is also in fluid communication with the interior of servo piston 42 through a fluid passage 76.

The pressure at the outlet 56 of the pump rises when the fluid power system supplied by the pump increases its working pressure. When this occurs, the pressure correspondingly increases in chamber 62 and attempts to push the compensator spool toward the right. If the outlet pressure rises high enough to overcome the force of pre-load spring 68, the compensator spool will move to the right of the position shown. When the spool moves, fluid pressure from chamber 62 is delivered to fluid passage 76 and into the interior of the servo piston 42. The servo piston moves to the right overcoming the force of spring 38. When the servo piston extends, the angle of the swash plate decreases. This reduces the volume of fluid flowing through the pump. As a result, the motor driving the pump does not have to provide as much power. This is because the pump is delivering a lesser volume of fluid at the elevated pressure.

When the pressure at outlet 56 drops, pre-load spring 68 moves the compensator spool back to the left. Fluid in the servo piston is pushed back through flow passage 76 into first chamber 62. The fluid then passes through a fluid passage 78 into a low pressure area inside the pump case. When the fluid pressure in the servo piston is relieved, the piston retracts and the volume of flow through the pump increases.

A problem with this system is that it cannot take full advantage of the power available from a particular motor. This is because the compensator valve must be preset to lower the flow whenever a fixed pressure is exceeded. The power delivered by a piston pump is a function of both volume and pressure. As this compensator valve assembly works on pressure only, it cannot take full advantage of the power available.

Another type of prior ar control valve for controlling the operation of a variable displacement rotating piston pump is shown in FIG. 3. This system includes a second compensating valve 80 which has a body 82. Body 82 includes first, second and third internal chambers 84, 86 and 88 respectively, which are connected. First chamber 84 is in communication with outlet passage 48 of the pump through a fluid passage 90. Second chamber 86 is connected to servo piston 42 of the pump through a fluid passage 92. Third chamber 88 is connected to a fluid passage 94 which extends through body 82. Fluid passage 94 extends through a fourth chamber 96 to a control port 98.

A spool 100 is moveably mounted in the valve body and extends through the first, second and third chambers. Spool 100 includes an orifice passage 102 which enables fluid to pass from the first chamber 84 to the third chamber 88 through the interior of spool 100. A differential spring 104 biases the spool to the left as shown in FIG. 3.

In operation of the second compensator valve 80, the flow through the pump (and thus the power required to drive the pump) may be controlled by varying the pressure at control port 98. The pressure delivered at the outlet 56 of the pump is communicated to first chamber 84 through fluid passage 90. The fluid pressure in the first chamber 84 is bled off to third chamber 88 through orifice passage 102 in spool 100. In the position of the spool shown in FIG. 3, no fluid is delivered to the servo piston 42 which is shown in its fully retracted position.

When the pressure at pump outlet 56 exerts a pressure on spool 100 which exceeds the biasing force of the differential spring 104 plus the controlled fluid pressure at control port 98, the spool moves to the right of the position shown in FIG. 3. When this occurs, fluid delivered to the first chamber 84 is enabled to pass into the servo piston 42 through the second chamber 86 and flow passage 92. As the servo piston extends, the angle of the swash plate 84 is reduced and the volume of fluid flow through the pump drops.

When the pressure at the outlet 56 falls, (or the control pressure at control port 98 increases) so that the forces pushing spool 100 to the left are greater than the pressure at the outlet port pushing it to the right, spool 100 moves back to the position shown in FIG. 3. When this occurs, fluid in servo piston 42 flows back into the second chamber 86 through flow passage 92. Then the fluid in the second chamber 86 flows into the case through a flow passage 106. As fluid leaves the servo piston it retracts, and the flow through the pump increases.

Although the system described above provides for variable control of the servo piston of the pump, there is a need to provide a pressure relief control to be sure the maximum pressure capability of the pump is not exceeded. This control is provided by a pressure relief valve portion generally indicated 108. The pressure relief valve portion includes an adjustable rod 110 which extends through forth chamber 96. The valve is threaded and the valve body and its position may be changed by rotating an adjusting nut 112. Rod 110 has an internal fluid chamber 114 which is open to fourth chamber 96 as shown.

A dart 116 is adjacent the opening to internal fluid chamber 114. A spring 118 biases the dart to close the opening When the force of spring 118 is exceeded by the force of the fluid in fourth chamber 96, the dart is pushed to the left and relieves pressure through a fluid passage 120 to second chamber 86. Fluid passage 120 is positioned so fluid therefrom is always passed to the case regardless of the position of spool 100. Relief valve portion 108 provides a fixed maximum pressure that can be held at control port 98, and thus the maximum pressure that can be produced at the outlet port of the pump before the servo piston moves to reduce flow.

The prior art construction of the second compensating valve is useful in that it provides for variable control of the volume of flow through the pump. However, it does not solve a significant problem associated with variable displacement rotating piston pumps. That problem is to control the volume flow through the pump in relation to the outlet pressure so that the power producing capabilities of a motor which is used to drive the pump are not exceeded. At the same time it is also necessary to fully utilize the power available from the motor. Thus there exists a need for a device which achieves these results.

DISCLOSURE OF INVENTION

It is an object of the present invention to provide a fluid pumping apparatus operable at variable flows and pressures that maintains its power output within the power delivery capability of a motor driving such apparatus.

It is a further object of the present invention to provide a power limiting apparatus for a variable displacement rotating piston pump.

It is a further object of the present invention to provide a power limiting system for a fluid power pump that includes a closed loop control system.

It is a further object of the present invention to provide a power limiting system for a fluid power pump that optimizes the fluid work obtained from a motor driving the pump.

It is a further object of the present invention to provide a system for controlling power output from a fluid power pump that avoids stalling the motor.

It is a further object of the present invention to provide a power limiting system for a fluid power pump that is reliable and low in cost.

It is a further object of the present invention to provide a method for maintaining the output loading of a fluid power pump within the power delivery capability of a motor driving the pump.

Further objects of the present invention will be made apparent in the following Best Mode for Carrying Out Invention and the appended claims.

The foregoing objects are accomplished in the preferred embodiment of the present invention using a variable displacement rotating piston pump of the type known in the prior art and previously described. A compensating valve the type known in the prior art and like second compensating valve 80, is in operative connection with the outlet of the pump as shown in FIG. 3.

The swash plate of the pump is mounted on trunion pins similar to pins 28 previously described, however, one of the pins is adapted to include an offset cylindrical cam which extends outward from the pump case. The pin and the attached cam move with the angle of the swash plate. The cam is in a first position when the swash plate of the pump is at a minimum angle and the pump is providing minimum flow. The cam is in a second position when the swash plate is at its maximum angle and the pump is providing its highest volume flow.

The outlet or control port of the compensating valve is connected to a variable pressure relief valve. The variable relief valve is connected to the cam on the pin which moves with the swash plate. The variable relief valve has a maximum relief pressure when the cam is in the first position (minimum flow) and has a minimum relief pressure when the cam is in the second position (maximum flow).

In operation, the pump is driven by a motor with a fixed power delivery capability. When the pump is delivering fluid to the system and the system is at a low pressure, the swash plate is at its greatest angle and provides maximum flow. If the system encounters increasing resistance, pressure rises at the outlet of the pump. Because at maximum flow, the variable relief valve relieves at a low pressure, it relieves as the system encounters greater resistance. This drops the pressure at the outlet of the compensating valve.

The drop in pressure at the outlet of the compensating valve causes the spool located therein to move to the right of the position of the spool shown in FIG. 3. When the spool moves, fluid is delivered to servo piston 42. The servo piston extends moving the swash plate and lowering the volume of flow through the pump.

When the swash plate moves to a smaller angle to reduce flow, the cam which is located on the pin, moves towards its first position. This increases the relief pressure. As a result, the variable relief valve eventually closes, again raising the pressure at the outlet port. This causes the spool to move back to the left and to relieve pressure to the servo piston until equilibrium is obtained.

A closed loop system is thus provided which maintains flow and pressure output from the pump within the power delivery capability of the motor which drives the pump.

BEST MODE FOR CARRYING OUT INVENTION

Figure 4:
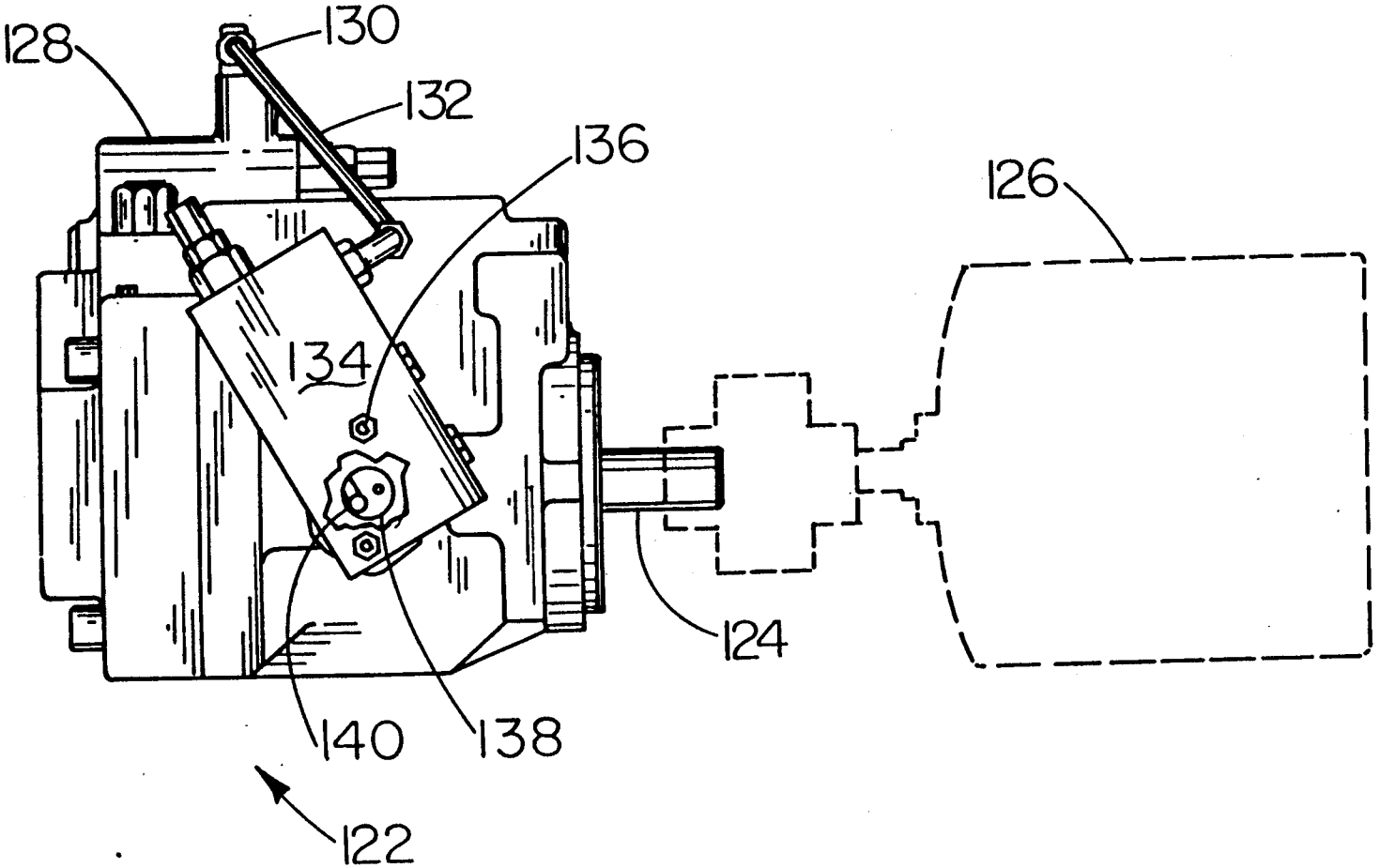
FIG. 4 is a partially sectioned view of a variable displacement rotating piston pump incorporating the preferred embodiment of the present invention.

Referring now to the drawings and particularly to FIG. 4, there is shown therein a variable displacement rotating piston pump 122. Pump 122 is identical in all respects to prior art pump 10 previously described with the exceptions mentioned. Pump 122 has a shaft which is driven by an electric motor 126 shown in phantom. The electric motor is a typical A/C electric motor which has a fixed maximum horsepower output capability and a fixed rotational speed.

A compensating valve assembly 128 is mounted on pump 122. The compensating valve assembly is identical in all respects to the second compensating valve 80 previously described. Compensating valve assembly 128 has an outlet 130 which corresponds to control port 98 of valve 80. Outlet 130 is connected to a pipe 132 which is connected to a variable pressure relief valve 134. The variable pressure relief valve 134 is held to the case of pump 122 by fasteners 136.

Figure 1:
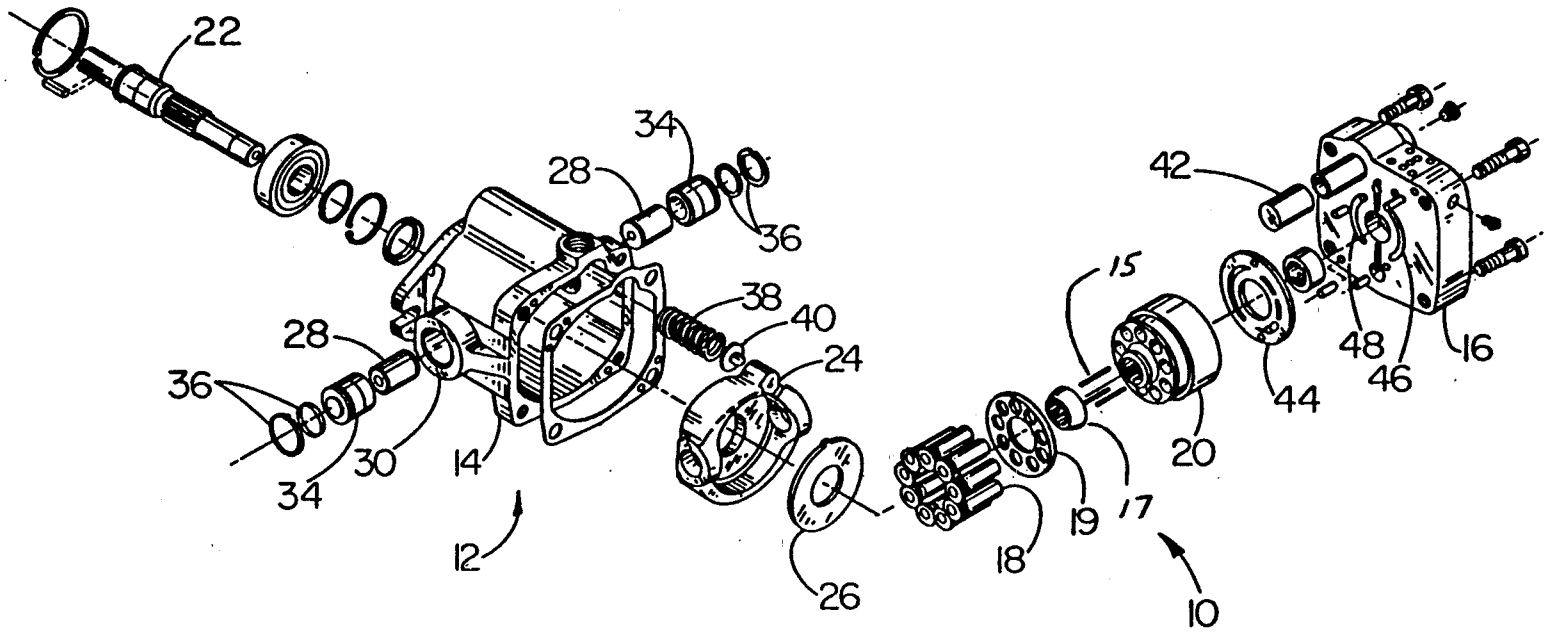
FIG. 1 is an exploded view of a prior art variable displacement rotating piston pump.
Figure 2:
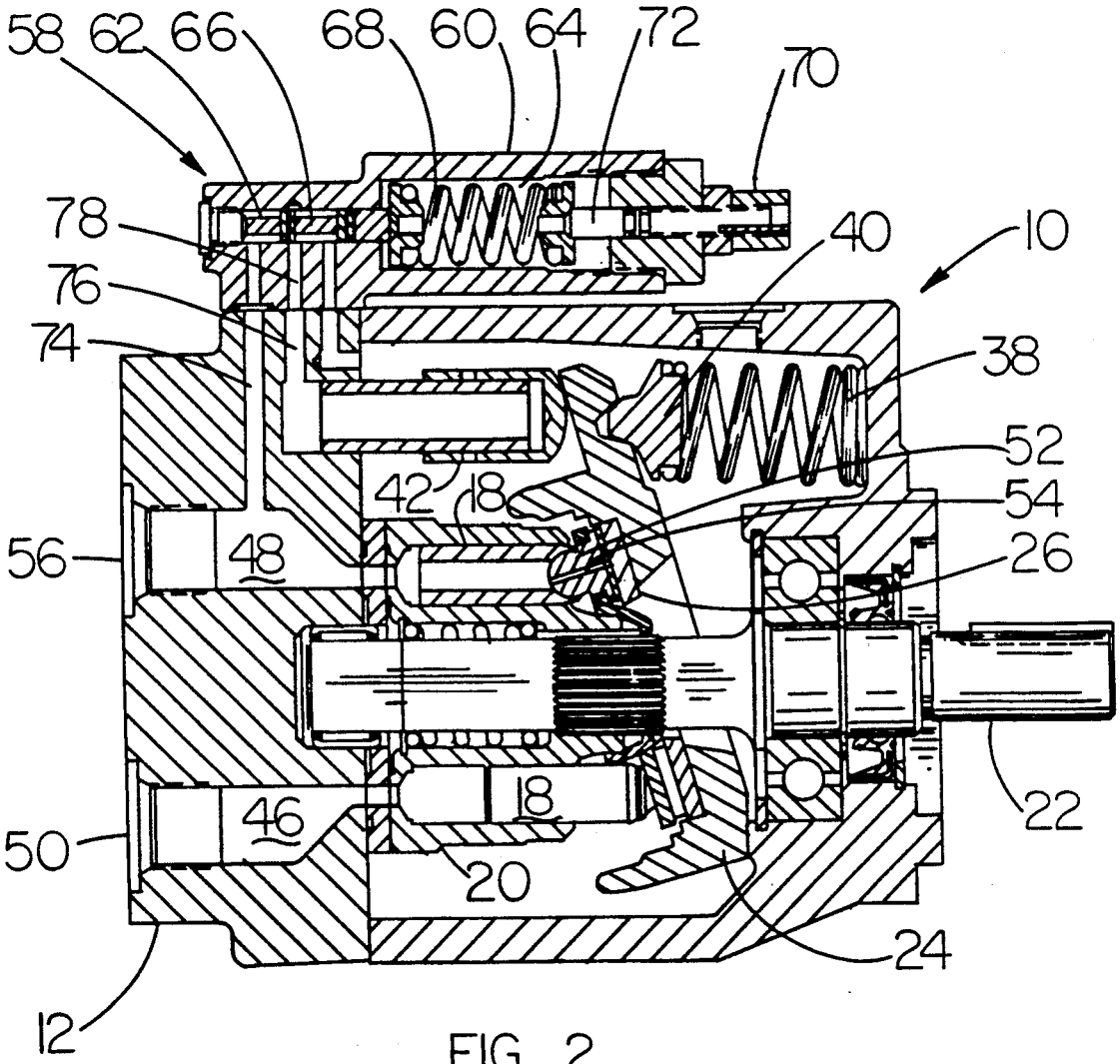
FIG. 2 (PRIOR ART)
FIG. 2 is a cross sectional view of the pump shown in FIG. 1 with first prior art compensating valve mounted thereon.
Figure 6:
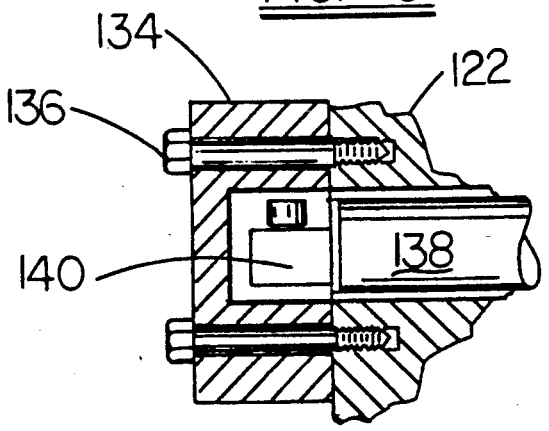
FIG. 6 is a cross sectional view of the pin and cam used in the preferred embodiment of the present invention.

A portion of relief valve 134 is shown sectioned in FIG. 4 to provide a side view of a pin 138. Pin 138 is attached to the swash plate of the pump and moves therewith. Extending from pin 138 is an offset cylindrical cam 140 (see FIG. 6). Pump 122 has only one pin 138 which includes a cam. The opposed pin, which supports the side of the swash plate opposite pin 136, is a conventional pin similar to trunion pins 28 shown in FIG. 1.

Figure 5:
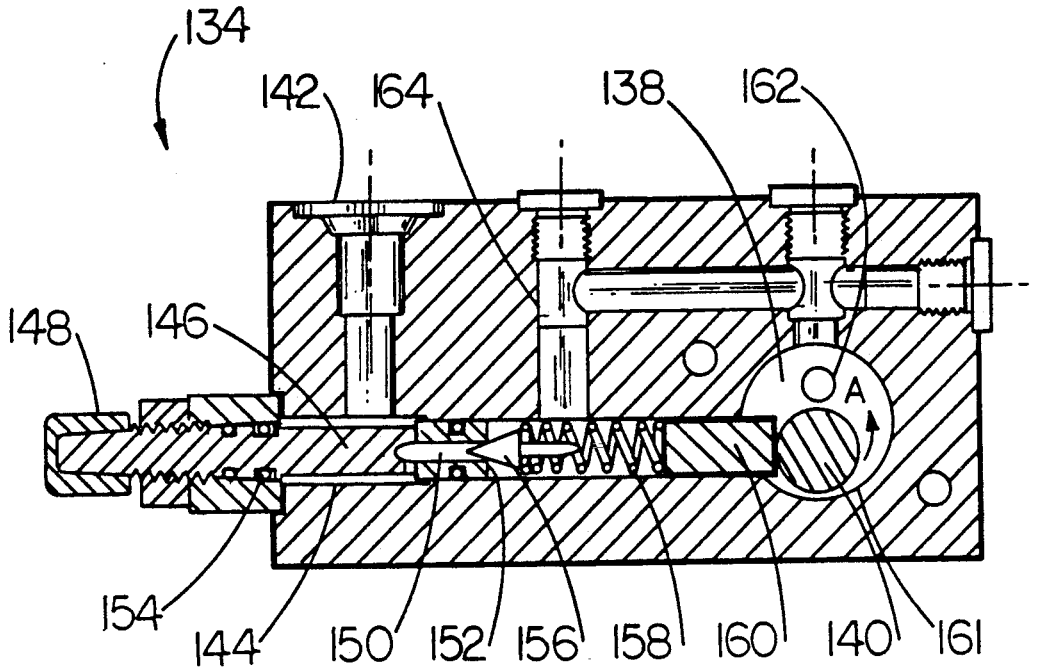
FIG. 5 is a cross sectional view of a variable pressure relief valve used in the preferred embodiment of the present invention.

Variable relief valve 134 is shown in greater detail in FIG. 5. The valve has an inlet 142 which is connected to pipe 132. Inlet 142 is in fluid communication with a chamber 144. An adjustable rod 146 is mounted in chamber 144 and is threaded therein to provide longitudinal adjustment by turning an adjusting nut 148. Rod 146 includes a flow passage 150 therein which is in fluid communication with inlet 142. Flow passage 150 terminates at its lower end in a circular opening 152. Two o-ring seals 154 are positioned in recesses on rod 146 to insure that fluid delivered to inlet 142 is directed only into flow passage 150.

A conical dart 156 is positioned adjacent circular opening 152. Dart 156 serves as a blocking body for opening 152. Dart 156 is biased toward the opening by a compression spring 158. A movable follower 160 supports the lower end of spring 158. Follower 160 extends into a circular cavity 161 in the body of relief valve 134 wherein it is supported by cam 140 of pin 138.

An opening 162 is also provided in pin 138. Opening 162 extends from cavity 161 to the interior of the pump case. Fluid passageways 164 extend from chamber 144 below dart 156, to circular cavity 161. Any fluid which passes through opening 152, past dart 156, is enabled to flow through passageways 164 into chamber 161. This fluid ma then flow back into the low pressure pump case through opening 162.

Cam 140 is in a first position shown in FIG. 5 when the angle of the swash plate is at a minimum (minimum flow). When the angle of the swash plate increases, the cam 140 moves in the direction of arrow A in FIG. 5 to a second position wherein the swash plate is at its maximum angle (maximum flow).

As shown in FIG. 5, when cam 140 is in the first position, spring 158 is compressed and exerts greater force on dart 156. As a result, valve 134 will relieve only at its highest relief pressure when the cam is in the first position. When cam 140 moves to the second position, the spring force on dart 156 decreases so that valve 134 will relieve at its minimum relief pressure. The relief pressure of valve 134 is continuously variable with movement of the cam between its first and second positions.

In operation the present invention provides for load limiting control which avoids loading the pump in excess of the power input capability of the motor which drives the pump. This is done by adjusting the force applied to the spool in compensating valve 128, as well as the force applied by spring 158, of variable pressure relief valve 134 so that the flow and pressure output from the pump cannot exceed the motor's power delivery capability.

In operation of the pump, when the hydraulic system served by the pump is at minimum pressure, the outlet of the pump is likewise at a minimum pressure. In this condition, the spool inside compensating valve 128 is in the position shown in FIG. 3. In this condition, the servo piston is fully retracted so that the pump provides maximum flow. Cam 140 is in the second position because the swash plate is at its maximum angle so that the relief pressure of variable pressure relief valve 134 is at its minimum value.

When the hydraulic system supplied by the pump encounters an increasing load, the pressure at the pump outlet rises. There is a corresponding rise in the pressure at outlet 130 of the compensating valve assembly due to the orifice passage through the spool of the compensating valve. The pressure also increases in pipe 132 and in chamber 144 of the variable pressure relief valve If the pressure is high enough to overcome the spring force on dart 156, the dart moves away from opening 152 and pressure is relieved.

Upon pressure being relieved by valve 134, the pressure at outlet 130 of the compensating valve drops. If the pressure at the pump outlet is sufficient to overcome the force of the differential spring and the pressure remaining at outlet 130, the spool of the compensating valve moves to deliver fluid to the servo piston inside the pump.

Delivery of fluid to the servo piston causes it to extend against the force of the balancing spring inside the pump. As the servo piston extends, the angle of the swash plate becomes smaller and the flow through the pump drops. Movement of the swash plate also moves pin 138 and cam 140. As the cam moves from the second position towards the first position, follower 160 moves inward. This increases the force pushing dart 156 into opening 152 and increases the relief pressure of valve 134.

Figure 7:
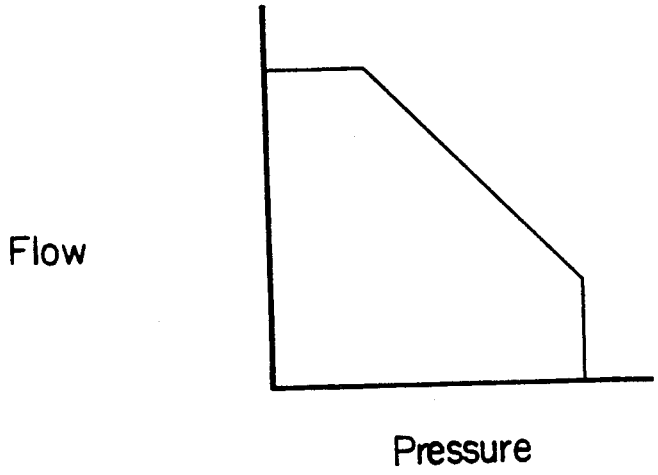
FIG. 7 is a graph of the relationship of fluid flow to fluid pressure produced by a variable displacement rotating piston pump incorporating the preferred embodiment of the present invention.

If the relief pressure is raised enough so that valve 134 closes (and assuming the pressure at the outlet of the pump remains constant), the system eventually stabilizes with the outlet pressure holding the servo piston and swash plate so that the pump delivers a flow rate and pressure within the power capacity of the motor driving the pump. As the pressure encountered by the system rises, the relief pressure rises and the swash plate moves to lower the flow. If the pressure drops, the servo piston retracts enabling increased flow while the relief pressure correspondingly drops. The combined effect of control through compensating valve assembly 128 with feedback from variable pressure relief valve 134 enables the fluid pump to achieve the performance curve shown in FIG. 7.

Figure 3:
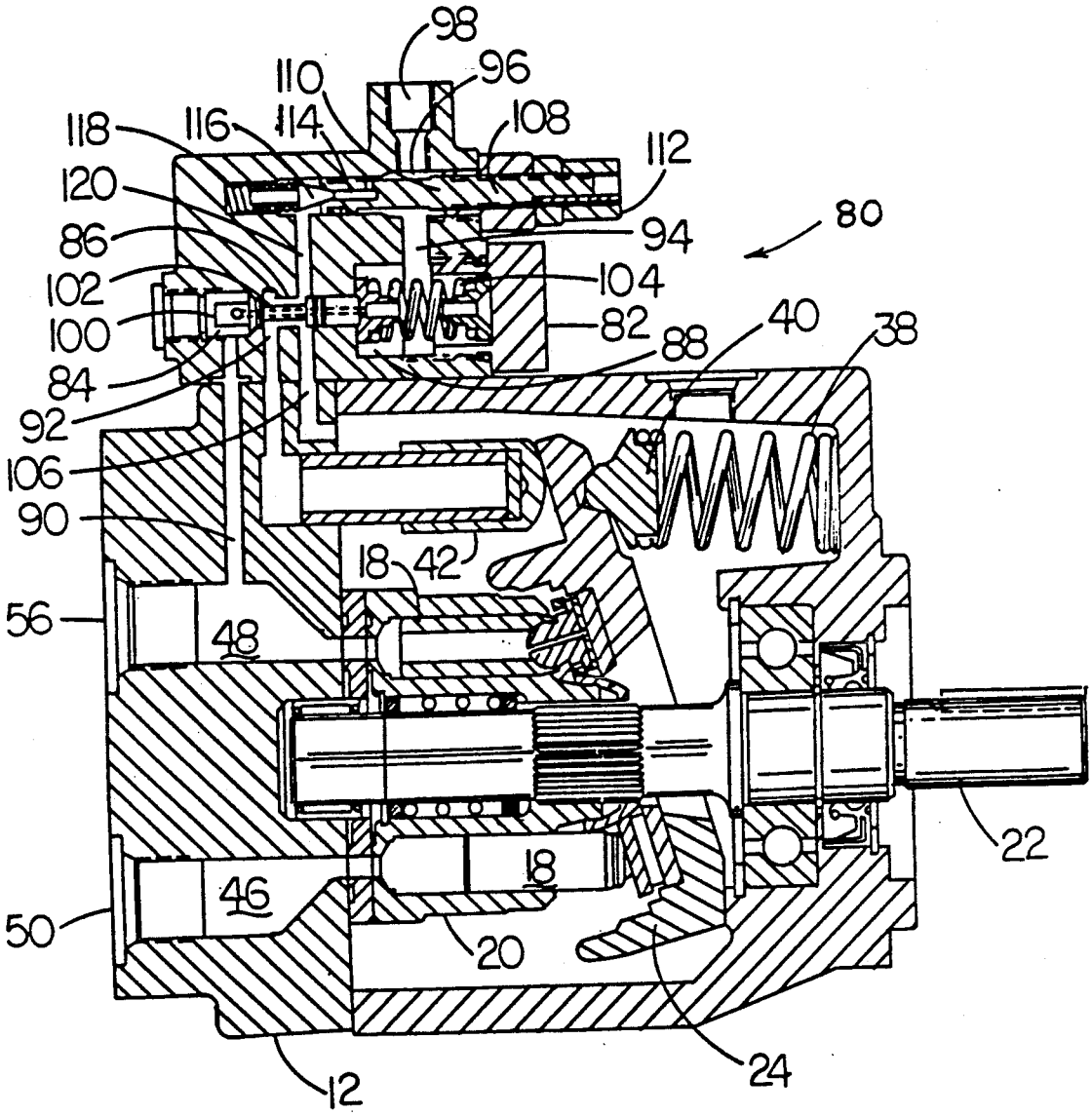
FIG. 3 (PRIOR ART)
FIG. 3 is a cross sectional view of the prior art pump shown in FIG. 1 with a second prior art compensating valve mounted thereon.

It should be mentioned that the compensating valve 128 of the preferred form of the invention also includes a relief valve portion similar to relief valve portion 108 in FIG. 3. This relief valve, serves to prevent the control pressure at outlet 130 from exceeding the preset pressure capabilities of the pump.

The present invention enables a variable displacement rotating piston pump to be controlled so that the flow is adjusted in response to pressure load and insures that the power delivery capability of the motor driving the pump are not exceeded. This invention enables operating many systems with a smaller motor than would otherwise be required. It further minimizes the risk of stalling due to overloading.

Thus, the invention achieves the above stated objectives, eliminates difficulties encountered in the use of prior devices and systems, and solves problems and attains the desirable results described herein.

In the foregoing description, certain terms have been used for brevity, clarity and understanding, however no unnecessary limitations are to be implied therefrom because said terms are used for descriptive purposes and are intended to be broadly construed. Moreover, the descriptions and illustrations given are by way of examples and the invention is not limited to the exact details shown or described.

Having described the features, discoveries and principles of the invention, the manner in which it is utilized and the advantages and useful results obtained, the new and useful structures, devices, elements, arrangements, parts, combination, systems, equipment, operations, methods and relationships are set forth in the appended claims.

We claim:

1. A fluid power apparatus for delivering a liquid working fluid at an outlet, said fluid delivered at varying flow rates and pressures, power for said apparatus provided by a motor means having a power output rating, said apparatus adapted to adjust said flow rate and said pressure at said outlet to avoid exceeding the power output rating of said motor means;

said apparatus comprising:

a variable volume piston pump driven by said motor means, said pump including an inlet in communication with a supply of said working fluid, an outlet, and a swash plate, said swash plate having a variable angle, the volume of fluid flow delivered from said outlet proportional to said angle, said pump further including a servo piston means in operative connection with said swash plate for varying the angle of said swash plate;

cam means in operative connection with said swash plate, said cam means moveable responsive to the angle thereof between a first position and a second position, said pump delivering a minimum fluid flow when said cam means is in the first position and a maximum fluid flow when said cam means is in a second position;

a compensation valve portion, said compensation valve portion including a CV inlet in fluid communication with the outlet of the pump, and a CV outlet, said compensation valve portion further including a first CV passage in fluid communication with said servo piston means of said pump, said compensation valve portion further including flow passage mean for delivering fluid from said pump outlet to said CV outlet; said CV valve portion further including means for delivering fluid from said CV inlet to said CV passage responsive to a differential pressure between said CV inlet and said CV outlet; and a variable relief valve means in operative connection with said cam means and said CV outlet, for relieving fluid pressure at said CV outlet in excess of a relief pressure, said relief pressure variable with the position of said cam means, said relief pressure at a maximum value when said cam means is in said first position and a minimum value when said cam means is in the second position;

whereby when said relief valve means relieves pressure fluid flows from said CV outlet, and the differential pressure between said CV inlet and said CV outlet enables fluid to be delivered to said servo piston means changing the angle of said swash plate and moving said cam means toward said first position, whereby said flow rate from said outlet is reduced and said relief pressure is increased until said relief valve means no longer relives pressure.

2. The apparatus according to claim 1 wherein said relief valve means comprises:

a flow passage, said fluid passing through said passage to relieve pressure;

a body adapted for blocking said flow passage; and biasing means for biasing said blocking body in abutting relation of said flow passage, said cam means in operative connection with said biasing means.

3. The apparatus according to claim 2 wherein said pump includes a pump body and said swash plate is in operative connection with at least one pin journalled in said pump body and rotatable with the angle of said swash plate;

and wherein said cam means comprises a projection extending from said pin;

and wherein said biasing means is a compression spring and said relief valve means further comprises a moveable follower engaging said projection and said compression spring.

4. A system for limiting the load on a variable displacement rotating piston pump, said pump having a moveable swash plate, said system including a pressure compensating valve including an outlet, the flow of said pump being controlled responsive to a control pressure at said outlet;

an improvement comprising;

variable pressure relief means for relieving fluid pressure, said relief mean in fluid communication with said outlet of said compensator valve and in operative connection with said swash plate;

wherein when said swash plate is at a minimum angle said pressure relief means relieves at a high pressure and when said swash plate is at a maximum angle said pressure relief means relieves at a low pressure.

5. The system according to claim 4 wherein said swash plate is connected in said pump to a pin and said pin is in operative connection with a cam, said pressure relief means in connection with said cam.

6. A method for maintaining the output load of a variable volume piston pump of the variable angle swash plate type, within the power delivery ability of a motor driving the pump comprising the steps of:

comparing fluid pressure at an outlet of said pump to a variable relief pressure; and when said relief pressure is exceeded, varying the angle of said swash plate to reduce fluid flow while correspondingly increasing said relief pressure with the variation of said angle;

whereby the pressure and flow are maintained within the power delivery ability of said motor.

* * * * *